US009227434B2

(12) United States Patent
Regelsberger et al.

(10) Patent No.: US 9,227,434 B2
(45) Date of Patent: Jan. 5, 2016

(54) PRECISION REGISTRATION IN A DIGITAL PRINTING SYSTEM

(71) Applicant: Eastman Kodak Company, Rochester, NY (US)

(72) Inventors: Matthias Hermann Regelsberger, Rochester, NY (US); Karlheinz Peter, Molfsee (DE); Gary Alan Kneezel, Webster, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/280,718

(22) Filed: May 19, 2014

(65) Prior Publication Data

US 2015/0328905 A1 Nov. 19, 2015

(51) Int. Cl.

| | |
|---|---|
| ***B41J 15/04*** | (2006.01) |
| ***B41J 2/155*** | (2006.01) |
| ***B41J 11/04*** | (2006.01) |
| ***B41J 15/00*** | (2006.01) |
| *B41J 3/60* | (2006.01) |

(52) U.S. Cl.

CPC ..... *B41J 11/04* (2013.01); *B41J 15/005* (2013.01); *B41J 2/155* (2013.01); *B41J 3/60* (2013.01)

(58) Field of Classification Search

CPC ..... B41J 13/076

See application file for complete search history.

(56) References Cited

U.S. PATENT DOCUMENTS

| | | | | |
|---|---|---|---|---|
| 4,534,288 | A | 8/1985 | Brovman | |
| 4,658,723 | A | 4/1987 | Tokuno et al. | |
| 5,440,328 | A * | 8/1995 | Nardone et al. | 347/173 |
| 6,493,012 | B2 | 12/2002 | Buch et al. | |
| 6,739,688 | B2 | 5/2004 | Kniazzeh et al. | |
| 2004/0189783 | A1 * | 9/2004 | Mogi | 347/218 |
| 2009/0283002 | A1 | 11/2009 | Schultze | |
| 2011/0074861 | A1 * | 3/2011 | Saettel et al. | 347/19 |
| 2011/0128337 | A1 * | 6/2011 | Muir et al. | 347/104 |
| 2013/0321544 | A1 * | 12/2013 | Vandagriff et al. | 347/104 |

FOREIGN PATENT DOCUMENTS

| | | | |
|---|---|---|---|
| JP | 10086472 A | * | 4/1998 |
| WO | 2013/063188 | | 5/2013 |

* cited by examiner

*Primary Examiner* — Shelby Fidler
(74) *Attorney, Agent, or Firm* — Kevin E. Spaulding

(57) ABSTRACT

A printing system for printing on a web of media traveling along a web transport path, including a plurality of printheads for printing on the web of media, each of the printheads being configured to print at one or more corresponding print locations along the web transport path. A plurality of web transport rollers guide the web of media along the web transport path. Each of the plurality of web transport rollers has a roller circumference that is substantially equal to an integer fraction of a span of the web of media along the web transport path between two successive print locations.

16 Claims, 10 Drawing Sheets

PRECISION REGISTRATION IN A DIGITAL PRINTING SYSTEM

CROSS REFERENCE TO RELATED APPLICATIONS

Reference is made to commonly assigned, co-pending U.S. patent application Ser. No. 14/280,707, entitled "Precision registration in printing cylinder systems" by K. Peter et al; to commonly assigned, co-pending U.S. patent application Ser. No. 14/280,714, entitled "Drive gears providing improved registration in printing cylinder systems" by K. Peter et al; and to commonly assigned, co-pending U.S. patent application Ser. No. 14/280,724, entitled "Drive gears providing improved registration in digital printing systems" by K. Peter et al, each of which is incorporated herein by reference.

FIELD OF THE INVENTION

This invention relates generally to the field of digital printing systems, and more particularly to a web transport design for improved registration of printed patterns from different printing stations in a roll-to-roll printing system.

BACKGROUND OF THE INVENTION

In a digitally controlled printing system, for example an inkjet printing system, a print media is directed through a series of components. The print media can be a cut sheet or a continuous web. A web or cut sheet transport system physically moves the print media through the printing system. As the print media moves through the printing system, marks are controllably made on the print media by one or more printheads, which are typically not in contact with the print media, to form the desired image or pattern.

For printing a color image, the printing system can have a plurality of printing stations, each having a printhead for printing one of the color channels (e.g., cyan, magenta, yellow and black) that make up the color image. If suitable color-to-color registration is not maintained in the printing system, print defects such as color halos at the edges of multicolor features can be seen.

Similarly, functional printing of devices can be done in multiple successive steps using a plurality of printing stations. If suitable registration is not maintained between printing stations, the performance of the printed device can be degraded. In fact, the desired registration tolerances for functional printing can be tighter than what is required for color image printing.

One approach for achieving registration of patterns printed by different printheads on a web of media is to use in-situ measurement techniques on the printed web such that the registration can be monitored and controlled to be within a required tolerance. Registration marks can be printed on the web of media at the same time as each color layer of the image is printed. The registration marks can be monitored by a control system and appropriate adjustments can be made to the printing process. For example, registering a pattern along the web motion direction (also called the in-track direction) that is being printed by a second digital printhead to a pattern that was printed previously by first digital printhead can be done by controlling the timing of the marking process of the second digital printhead. For example, for inkjet printheads the timing of the jetting of the ink drops by the second printhead can be advanced or delayed as needed.

Although methods exist for registering portions of the print that are successively printed by different printheads, what is needed for precision printing is to design the web transport for a roll-to-roll digital printing system in such a way that the size of registration errors introduced in the printing system is reduced.

SUMMARY OF THE INVENTION

The present invention represents a printing system for printing on a web of media traveling along a web transport path, comprising:

a plurality of printheads for printing on the web of media, each of the printheads being configured to print at one or more corresponding print locations along the web transport path;

a plurality of web transport rollers to guide the web of media along the web transport path;

wherein each of the plurality of web transport rollers has a roller circumference that is substantially equal to an integer fraction of a span of the web of media along the web transport path between two successive print locations.

This invention has the advantage that disturbances in the motion of the web of media caused by any run-out or other imperfections in the web-transport rollers are made more consistent by keeping the rollers all in phase with each other.

It has the additional advantage that registration errors between image data printed by the different print stations are reduced.

Figure 1:
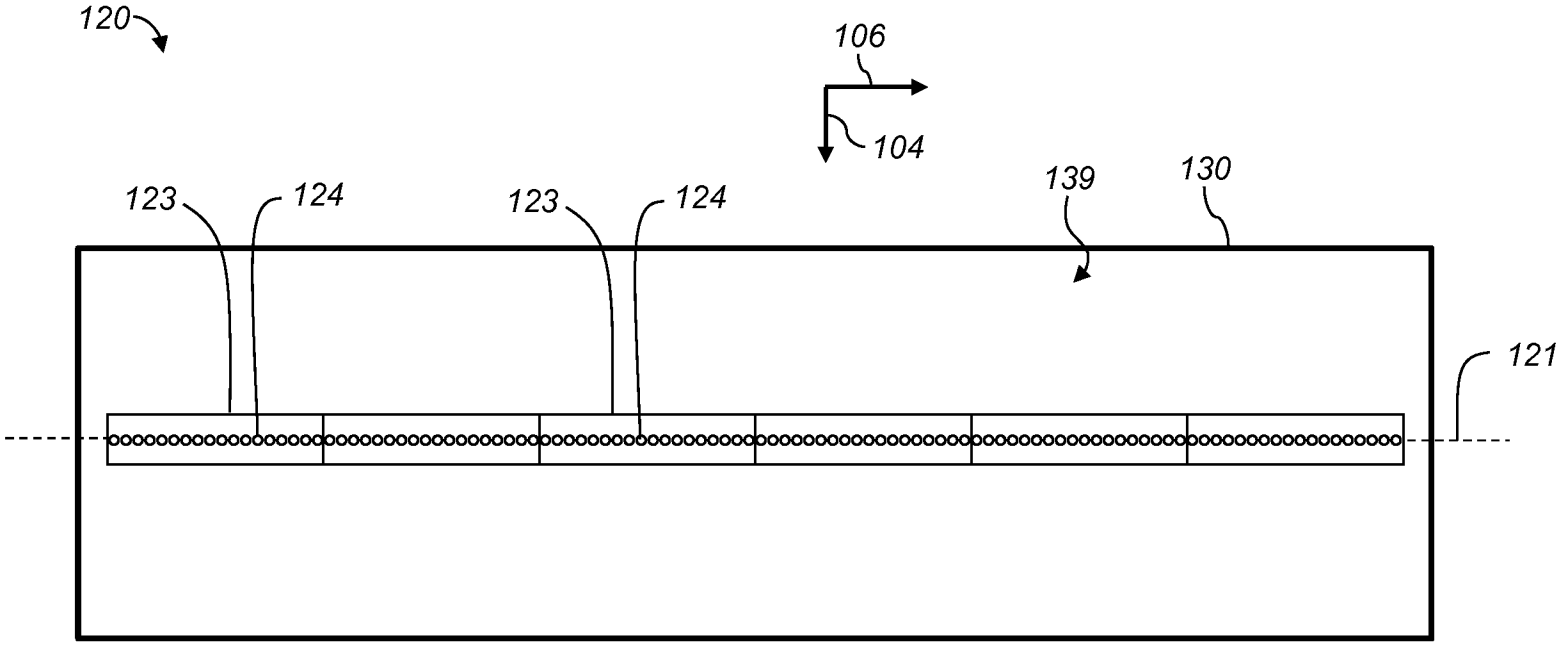
FIG. 1 is a view of a face of a digital printhead having a single print line.

It is to be understood that the attached drawings are for purposes of illustrating the concepts of the invention and may not be to scale.

DETAILED DESCRIPTION OF THE INVENTION

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, similar or identical reference numerals have been used, where possible, to designate identical elements. It is to be understood that elements and components can be referred to in singular or plural form, as appropriate, without limiting the scope of the invention.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. It should be noted that, unless otherwise explicitly noted or required by context, the word "or" is used in this disclosure in a non-exclusive sense.

The example embodiments of the present invention are illustrated schematically and not to scale for the sake of clarity. One of ordinary skill in the art will be able to readily determine the specific size and interconnections of the elements of the example embodiments of the present invention.

As described herein, the exemplary embodiments of the present invention provide a printhead or printhead components typically used in digital printing systems such as inkjet printing systems. However, many other applications are emerging which use digital printheads to make marks of various types on print media (sometimes called receiver media). For example, inkjet printheads can be used to emit liquids that need to be finely metered and deposited with high spatial precision. Such liquids include inks, both water-based and solvent-based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by inkjet printheads or inkjet printhead components described below.

Inkjet printing is commonly used for printing on paper, however, there are numerous other materials in which inkjet is appropriate. For example, the print media can be vinyl sheets, plastic sheets, textiles, paperboard, or corrugated cardboard. Additionally, although the term inkjet is often used to describe the printing process, the term jetting is also appropriate wherever ink or other liquids is applied in a consistent, metered fashion, particularly if the desired result is a thin layer or coating.

Inkjet printing is a non-contact application of a liquid such as an ink to a print media. Typically, one of two types of ink jetting mechanisms are used and are categorized by technology as either drop on demand ink jet (DOD) or continuous ink jet (CIJ).

The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand inkjet type uses thermal energy to eject ink drops from a nozzle. A heater, located at or near the nozzle, heats the ink sufficiently to form a vapor bubble that creates enough internal pressure to eject an ink drop. This form of inkjet is commonly termed "thermal ink jet." A second commonly practiced drop-on-demand inkjet type uses piezoelectric actuators to change the volume of an ink chamber to eject an ink drop.

The second technology, commonly referred to as "continuous" ink jet (CIJ) printing, uses a pressurized ink source to produce a continuous stream of ink by forcing ink, under pressure, through a nozzle. The stream of ink is perturbed using a drop forming mechanism such that the stream of ink breaks up into drops of ink in a predictable manner. One continuous inkjet printing type uses thermal stimulation of the stream of ink with a heater to form drops that eventually become print drops and non-print drops. Printing occurs by selectively deflecting either the print drops or the non-print drops and catching the non-print drops. Various approaches for selectively deflecting drops have been developed including electrostatic deflection, air deflection, and thermal deflection.

More generally, digital printing systems can include printheads having arrays of marking elements that are controlled to make marks on a print media as the printheads and print media are moved relative to one another in order to form a desired pattern. FIG. 1 is a view of a face of a printhead 120 having a support structure 130 onto which a plurality of printhead modules 123 are mounted. Each printhead module 123 includes a marking element array 124. In the example shown in FIG. 1 there are six printhead modules 123 mounted end to end on a surface 139 of support structure 130 so that the marking element arrays 124 are disposed substantially along a single print line 121 that is parallel to the marking element array direction 106 (also called the cross-track direction). In the particular case where printhead 120 is an inkjet printhead, marking elements in the marking element array 124 are inkjet nozzles. With reference to FIG. 1, the web of media (not shown) would be moved past printhead 120 along media advance direction 104 (also called the in-track direction).

The invention described herein is applicable to both drop on demand and continuous inkjet printing technologies, as well as other digital printing technologies employing a printhead including an array of marking elements. As such, the term printhead, as used herein, is intended to be generic and not specific to a particular technology.

Figure 2:
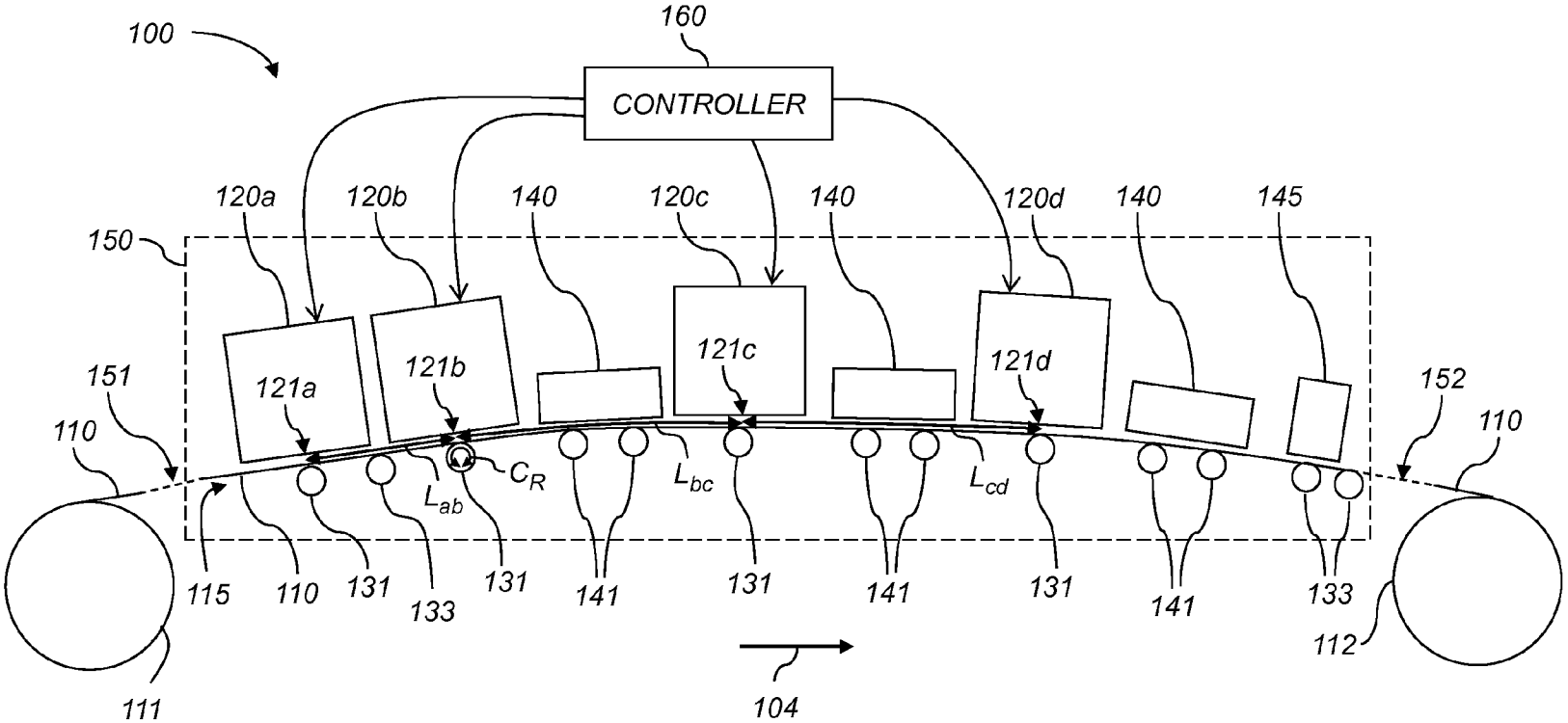
FIG. 2 is a simplified side view of a digital printing system for printing on a web of media using single-print-line printheads.

Referring to FIG. 2, there is shown a simplified side view of a portion of an inkjet printing system 100 for printing on a first side of a continuous web of media 110. The inkjet printing system 100 includes a printing module 150 which includes printheads 120*a*, 120*b*, 120*c*, 120*d*, dryers 140, and a quality control sensor 145. In this example, the first (leftmost) printhead 120*a* jets cyan ink, the second printhead 120*b* jets magenta ink, the third printhead 120*c* jets yellow ink, and the fourth (rightmost) printhead 120*d* jets black ink. A controller 160 controls the inkjet printing system 100, and performs various control functions including controlling the printheads 120*a*, 120*b*, 120*c*, 120*d* according to image data to produce a printed image.

Web transport rollers guide the web of media 110 from upstream to downstream along a web transport path 115 through the printing module 150. (The terms "upstream" and "downstream" are terms of art referring to relative positions along the web transport path 115; points on the web of media 110 move from upstream to downstream.) In this example, below each printhead 120*a*, 120*b*, 120*c*, 120*d* is a corresponding print line roller 131 that guides the web of media 110 in the media advance direction 104 past a corresponding print line 121*a*, 121*b*, 121*c*, 121*d* as the web of media 110 is advanced along the web transport path 115 through printing module 150. Below each dryer 140 is at least one dryer roller 141 for controlling the position of the web of media 110 near the dryers 140. Various other support rollers 133 also support and guide the web of media 110 as it moves along the web transport path 115 through printing module 150.

The web of media 110 originates from a supply roll 111 of unprinted print media and ends up on a take-up roll 112 of printed print media. Other details of printing system are not shown in FIG. 2 for simplicity. To the left of printing module 150, a first zone 151, illustrated as a break in the web of media 110, can include a slack loop, a web tensioning system, an edge guide and other elements that are not shown in FIG. 2. To the right of printing module 150, a second zone 152, illustrated as a break in the web of media 110, can include other components such as a turnover mechanism (e.g., see FIG. 8) and a second printing module (e.g., see FIG. 8) similar to printing module 150 for printing on a second side of web of media 110.

Embodiments of the invention provide design criteria for a printing system 100 that prints on a continuous web of media 110 traveling along a web transport path 115, where the printing system 100 has a plurality of printheads 120*a*, 120*b*, 120*c*, 120*d* for printing on the web of media 110, each of the printheads 120*a*, 120*b*, 120*c*, 120*d* being configured to print at one or more corresponding print locations (e.g., at print lines 121*a*, 121*b*, 121*c*, 121*d*) along the web transport path 115. The design criteria are intended to reduce disturbances in the motion of the web of media 110 as it is conveyed through the printing system 100. By reducing such disturbances there is greater reproducibility and registration precision in the composite printed patterns that are formed by the plurality of printheads at the various print locations.

In particular it is observed that the web-transport rollers, including print line rollers 131, dryer rollers 141 and support rollers 133 tend not to be perfectly uniform. A roller can be out of round or eccentrically mounted for example. Such non-uniformities in rollers supporting the web of media 110 can result in non-uniformity in the motion of the web of media 110. This can adversely affect registration between successive printed patterns along media advance direction 104. In order to reduce the overall non-uniformity in the motion of the web of media 110, it is beneficial for the individual non-uniformities of the various web-transport rollers to remain in phase from one print location to the next print location. It is therefore advantageous for each web transport roller in a printing module 150 to complete an integer number of revolutions as the web of media 110 is advanced from one print location (e.g. print line 121*a*) to the next downstream print location (e.g. print line 121*b*). This design criterion can equivalently be stated as each of the plurality of web transport rollers (including print line rollers 131, dryer rollers 141 and support rollers 133) has a roller circumference $C_R$ that is substantially equal to an integer fraction of a span L of the web of media 110 between two successive print locations. That is, the roller circumference $C_R$ of each web-transport roller satisfies the design criterion that:

$$C_R=L/N \tag{1}$$

where N is a positive integer. By substantially equal it is meant that the roller circumference $C_R$ of each of the web transport rollers is equal to an integer fraction of the span of the web of media 110 between successive print locations to within 1.0%, and more preferably to within 0.1%.

It is not required that the web transport rollers all have the same roller circumference as each other, only that each web transport roller has a circumference that is an integer fraction of the span L of the web of media 110 between successive print locations. However, the case where all web transport rollers have the same circumference can be advantageous from the standpoint of commonality of parts.

Where the web of media 110 follows a substantially straight path (as is the case between successive print lines 121*a* and 121*b* in the example shown in FIG. 2), the span (e.g., $L_{ab}$) of the web of media 110 is simply the distance between print lines 121*a* and 121*b*. Where the web of media 110 is not straight (as between print lines 121*b* and 121*c* in the example shown in FIG. 2), the span (e.g., $L_{bc}$) of the web of media 110 is the total length of the web between the print locations if the curved web were pulled straight, so that the span is longer than the straight line distance between the two successive print locations.

In the example shown in FIG. 2, not all of the web spans between successive print locations are the same. In particular, because there is no dryer 140 between printheads 120*a* and 120*b*, the web span $L_{ab}$ between the first and second print locations corresponding to print lines 121*a* and 121*b* is shorter than the web span $L_{bc}$ between second and third print locations corresponding to print lines 121*b* and 121*c*. The web span $L_{ab}$ between first and second print locations corresponding to print lines 121*a* and 121*b* is also shorter than the web span $L_{cd}$ between third and fourth print locations corresponding to print lines 121*c* and 121*d*. In order to keep roller non-uniformities in phase from one print location to the next, it is beneficial for each web span $L_{ab}$, $L_{bc}$, $L_{cd}$ to be substantially equal to integer multiples of the roller circumferences $C_R$ of each of the various web transport rollers in the printing module 150. In this case, the roller circumference $C_R$ of each web-transport roller should satisfy the design criterion that:

$$C_R=L_{ab}/N_1=L_{bc}/N_2=L_{cd}/N_3 \tag{2}$$

where $N_1$, $N_2$ and $N_3$ are positive integers. Positioning the various components of the printing system to satisfy this design criterion will have the effect that each of the web-transport rollers will be in the same angular orientation (i.e., have the same phase) whenever a particular location on the web of media 110 is passing by each of the print lines 121*a*, 121*b*, 121*c*, 121*d*. As a result, any non-uniformities in the motion of the web of media 110 caused by irregularities in the web-transport rollers will be consistent at each print location, thereby reducing relative registration errors between the image content printed by the different printheads 120*a*, 120*b*, 120*c*, 120*d* (e.g., color-to-color registration errors). Furthermore, the registration errors for the image content printed by a particular 120*a*, 120*b*, 120*c*, 120*d* will be much more consistent and predictable from one frame to another since the rollers will all be in consistent angular orientations for a given location within the frame. As a result, the registration errors can be characterized as a function of position within the image frame (for example by using the quality control sensor 145 to sense the position of registration marks printed in the margin of the printed image), and can be compensated for by providing a correction function which specifies compensating shifts to be applied during the process of printing the image data. For example, if a particular image line at a particular location within the image frame is found to be consistently shifted by a certain displacement from its nominal position, then the controller 160 can control the timing of when the printheads 120*a*, 120*b*, 120*c*, 120*d* print the image data for that print line accordingly (e.g., the timing can be advanced or delayed).

Figure 3:
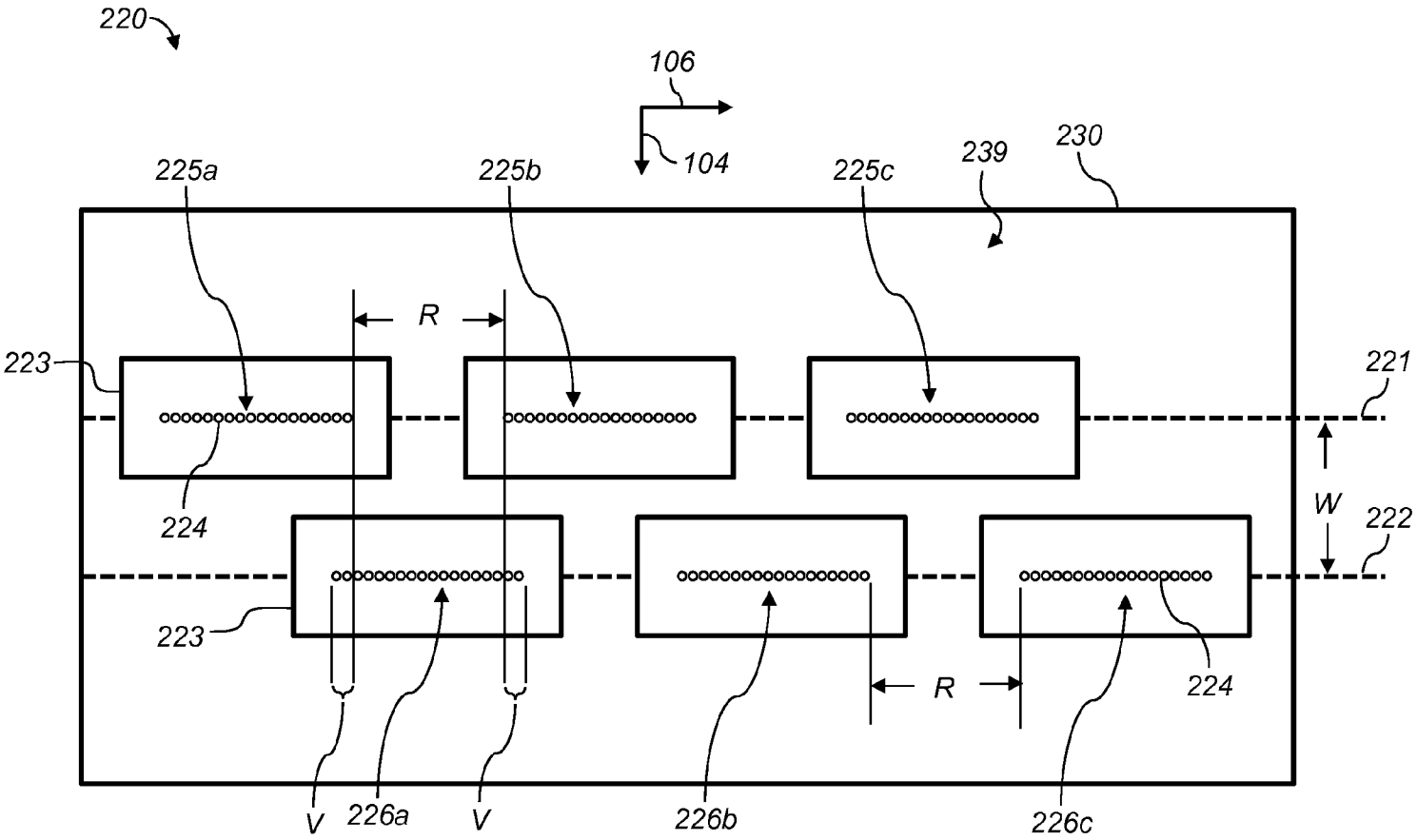
FIG. 3 is a view of a face of a digital printhead having two staggered print lines.

Although the printhead shown in FIG. 1 and used in the inkjet printing system 100 of FIG. 2 has a single print line 121 of marking element arrays 124, other configurations of printheads can have marking element arrays that are disposed along a plurality of print lines. FIG. 3 is a view of a face of a printhead 220 having a support structure 230 with a surface 239 on which are mounted a plurality of printhead modules 223 positioned in two rows in a staggered arrangement.

In the exemplary embodiment of FIG. 3, the printhead 220 includes three inkjet nozzle arrays 225*a*, 225*b* and 225*c* arranged along a first print line 221, each inkjet nozzle array 225*a*, 225*b*, 225*c* including a corresponding group of nozzles 224 that extends along the first print line 221 in a marking element array direction 106. Inkjet nozzle array 225*a* is separated from inkjet nozzle array 225*b* along first print line 221 by an intervening non-printing region R. Similarly, printhead 220 also includes three inkjet nozzle arrays 226*a*, 226*b* and 226*c* arranged along a second print line 222, each inkjet nozzle array 226*a*, 226*b*, 226*c* including a corresponding group of nozzles 224 that extend along second print line 222 in the marking element array direction 106. The inkjet nozzle array 226*a*, 226*b*, 226*c* disposed along the second print line 222 are adapted to eject drops of ink (not shown) onto portions of the receiver medium that are complementary to portions that are printed by the inkjet nozzle arrays 225*a*, 225*b*, 225*c* disposed along the first print line 221. Adjacent inkjet nozzle arrays 226*a*, 226*b*, 226*c* are separated from each other along second print line 222 by intervening non-printing regions R. An inkjet printhead 220 having such a staggered formation including inkjet nozzle arrays 225*a*, 225*b*, 225*c*, 226*a*, 226*b*, 226*c* arranged along first and second print lines in an alternating pattern is sometimes called a "staggered inkjet printhead." The first and second print lines 221 and 222 are parallel and are spaced apart along media advance direction 104 by a spacing distance W, which in some embodiments is on the order of six inches. If a web of media 110 (FIG. 4) is advanced along media advance direction 104 at a speed S, then a timing delay of $\Delta t=W/S$ of ejecting drops of ink from nozzles 224 in second print line 222 is used relative to ejecting drops of ink from nozzles 224 in first print line 221. In that way, if the image to be printed includes a straight line across the web of media 110, portions of the straight line printed by nozzles 224 from first print line 221 will line up with portions of the straight line printed by nozzles 224 from second print line 222. Inkjet nozzle arrays 225*a*, 225*b*, 225*c* along first print line 221 are offset from inkjet nozzle arrays 226*a*, 226*b*, 226*c* such that the non-printing regions R along first print line 221 are aligned with the inkjet nozzle arrays 226*a*, 226*b*, 226*c* along second print line 222, and vice versa. The ends of the inkjet nozzle arrays 225*a*, 225*b*, 225*c* of the first print line 221 generally overlap with the ends of the inkjet nozzle arrays 226*a*, 226*b*, 226*c* of the second print line 222 to produce overlap regions V. The overlap regions V enable the printed image from overlapped inkjet nozzle arrays 225*a*, 225*b*, 225*c*, 226*a*, 226*b*, 226*c* to be stitched together without a visible seam through the use of appropriate stitching algorithms that are known in the art.

Figure 4:
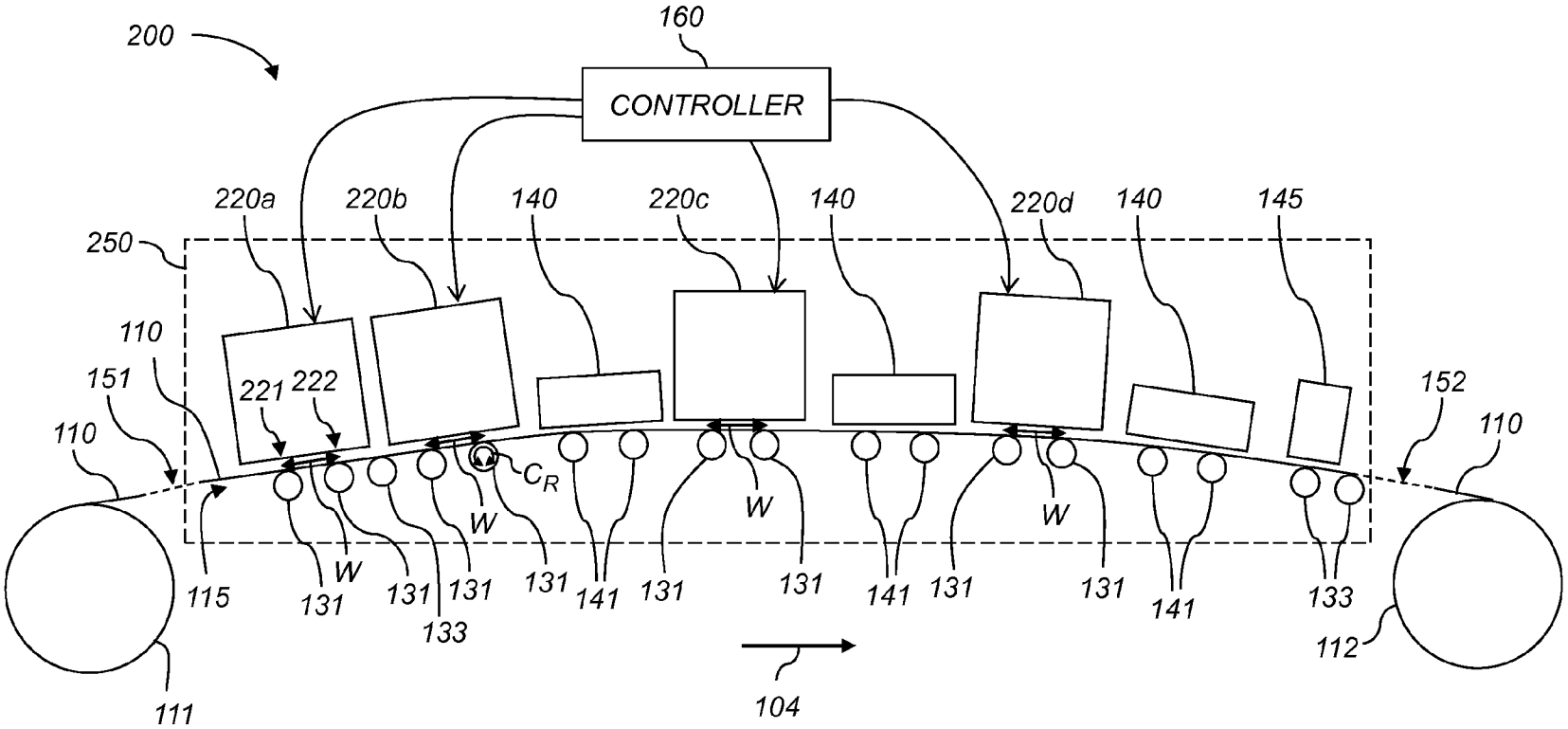
FIG. 4 is a simplified side view of a digital printing system for printing on a web of media using two-print-line printheads.

Referring to FIG. 4, there is shown a simplified side view of a portion of an inkjet printing system 200 for printing on a first side of a continuous web of media 110 of print media using staggered inkjet printheads 220*a*, 220*b*, 220*c*, 220*d* of the type shown in FIG. 3. The inkjet printing system 200 includes a printing module 250 which includes printheads 220*a*, 220*b*, 220*c*, 220*d*, dryers 140, and a quality control sensor 145. In this example, the first (leftmost) printhead 220*a* jets cyan ink, the second printhead 220*b* jets magenta ink, the third printhead 220*c* jets yellow ink, and the fourth (rightmost) printhead 220*d* jets black ink. Below each printhead 220*a*, 220*b*, 220*c*, 220*d* are print line rollers 131 that guide the web of media 110 past the first print line 221 and the second print line 222 of each printhead 220*a*, 220*b*, 220*c*, 220*d* as the web of media 110 is advanced through the printing module 250 along the web transport path 115. Below each dryer 140 is at least one dryer roller 141 for controlling the position of the web of media 110 near the dryers 140. Various other support rollers 133 also support and guide the web of media 110 as it moves along the web transport path 115 through printing module 250. The web of media 110 originates on a supply roll 111 of unprinted print media and ends up on a take-up roll 112 of printed print media. Other details of printing system are not shown in FIG. 4 for simplicity. To the left of printing module 250, a first zone 151 illustrated as a break in the web of media 110 can include a slack loop, a web tensioning system, an edge guide and other elements that are not shown. To the right of printing module 250, a second zone 152 illustrated as a break in the web of media 110 can include elements such as a turnover mechanism (not shown) and a second printing module (not shown) similar to printing module 250 for printing on a second side of the web of media 110.

Registration considerations for inkjet printing system 200 of FIG. 4 are similar to the registration considerations for the inkjet printing system 100 of FIG. 2 that were described above. However, printheads 220*a*, 220*b*, 220*c*, 220*d* of the type shown in FIGS. 3 and 4 have a plurality of print lines 221, 222 for each printhead 220*a*, 220*b*, 220*c*, 220*d*. It is important to maintain good registration of dots formed on the web of media 110 by print locations corresponding to first and second print lines 221 and 222 of each printhead 220 in addition to maintaining good registration of dots formed by the different printheads 220*a*, 220*b*, 220*c*, 220*d*. It is therefore advantageous for each web transport roller in printing module 250 to complete an integer number of revolutions while advancing the web of media 110 from one print location (e.g., first print line 221 of printhead 220*a*) to the next print location (e.g., second print line 222 of the same printhead 220*a*). This design rule can equivalently be stated as each of the plurality of web transport rollers (including print line rollers 131, dryer rollers 141 and support rollers 133) has a roller circumference $C_R$ that is substantially equal to an integer fraction of a span of the web of media 110 between two successive print locations that correspond to first print line 221 and second print line 222 of each printhead 220*a*, 220*b*, 220*c*, 220*d*. Since the distance between first and second print lines 221 and 222 is W (FIG. 3), if the web of media 110 is straight between the first print line 221 and the second print line 222, as in FIG. 4, then the design criterion is that:

$$C_R=W/M \tag{3}$$

where M is a positive integer. In a preferred embodiment, both this design criterion and the design criterion discussed earlier with respect to Eqs. (1)-(2) are satisfied simultaneously. However, a partial benefit can be obtained if even one of these design criteria is satisfied.

Other design considerations for web transport rollers include strength and stability, which are related to the size and weight of media to be used in the printing system, as well as the intended web tension and the wrap angle of the media around the web transport rollers. If the diameter of a web transport roller is too small, it will have insufficient strength to support the web of media 110 without flexing and causing conveyance non-uniformity. As indicated above with reference to FIG. 3, in some embodiments the distance between first and second print lines 221 and 222 on printhead 220 can be on the order of six inches. Since the circumference of a cylinder is $C_R=\pi D$, where D is the diameter of the cylinder, if the web of media 110 is straight between first and second print lines 221 and 222 as in FIG. 4, then the design rule that each web transport roller circumference $C_R$ is substantially equal to W/M can require that the diameter of the various web transport rollers be less than two inches in such embodiments. A two inch diameter can be too small for sufficient strength and stability in a web transport roller in a printing system. In such cases, the web transport path 115 can be modified as shown in FIG. 5 by inserting a span extension roller 135 (or some other type of span extension member such as a fixed media guide or an air shoe) between the pair of print line rollers 131 corresponding to each printhead 220*a*, 220*b*,

220*c*, 220*d*. In this way, the web span between print locations corresponding to first and second print lines 221 and 222 for each printhead 220*a*, 220*b*, 220*c*, 220*d* can be increased to provide an extended spacing distance $W_e$ so that the diameters of the web transport rollers (including print line rollers 131, span extension rollers 135, dryer rollers 141 and support rollers 133) can be larger to provide greater stability while still satisfying the design rule that each of the plurality of web transport rollers has a roller circumference that is substantially equal to an integer fraction of the span of the web of media 110 between two successive print locations that correspond to first and second print lines 221 and 222 of a particular printhead 220*a*, as well as between the print locations associated with the different printheads 220*a*, 220*b*, 220*c*, 220*d*.

Figure 5:
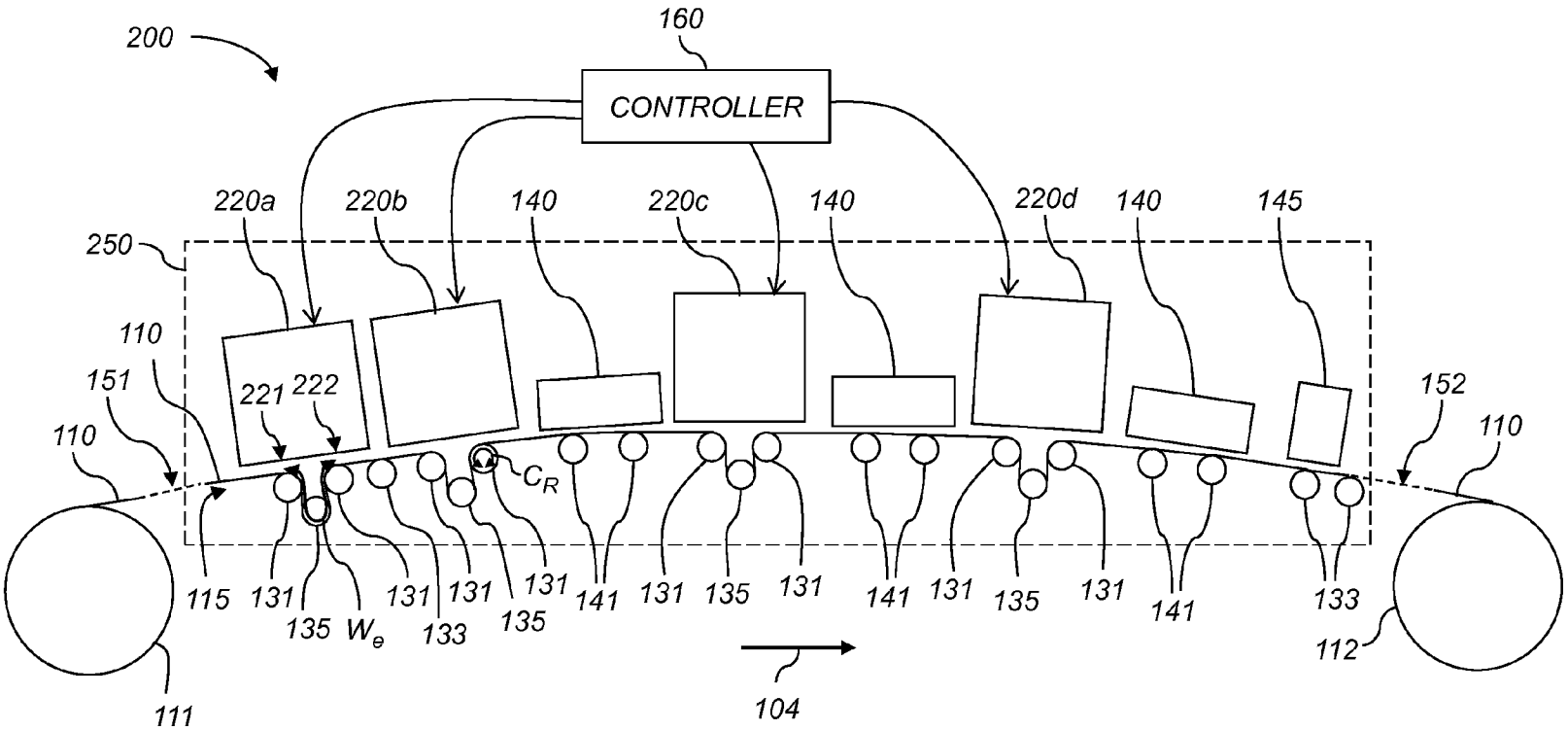
FIG. 5 is a simplified side view of a digital printing system for printing on a web of media using two-print-line printheads according to an alternate embodiment.

Since the span extension roller 135 in the configuration of FIG. 5 contacts the imaging side of the web of media 110 just after the ink is applied at print line 221, the use of a conventional roller may not be desirable in some cases, depending on the ink and media characteristics, if the ink will not be sufficiently dried and adhered to the web of media 110 prior to coming into contact with the span extension roller 135. To mitigate any problems that could occur due to ink smearing, a contoured roller (or a contoured fixed media guide) as described in commonly-assigned, co-pending U.S. patent application Ser. No. 13/923,403 to Kasiske et al., entitled "Inkjet printing system with contoured media guide," which is incorporated herein by reference, can be used for the span extension roller 135. In this case, the span extension roller 135 is provided with a contoured surface which has recessed areas that are aligned with the inkjet nozzle arrays 225*a*, 225*b*, 225*c* (FIG. 3) in the first print line 221, so that the span extension roller 135 only contacts the web of media 110 in regions that were not printed at the first print line 221.

Alternately, the span extension member can be an air shoe where the web of media 110 rides around the air shoe on a cushion of air so that the printed surface of the web of media 110 does not contact the surface of the air shoe. Air shoes are well-known in the media-guiding art and generally include a fixed media guide surface with holes or grooves through which a stream of air is blown to lift the media away from the media guide surface. In some embodiments, the air shoe can be of the type described in commonly-assigned, co-pending U.S. patent application Ser. No. 14/190,146 to Cornell et al., entitled "Air shoe with roller providing lateral constraint," which is incorporated herein by reference.

Figure 6:
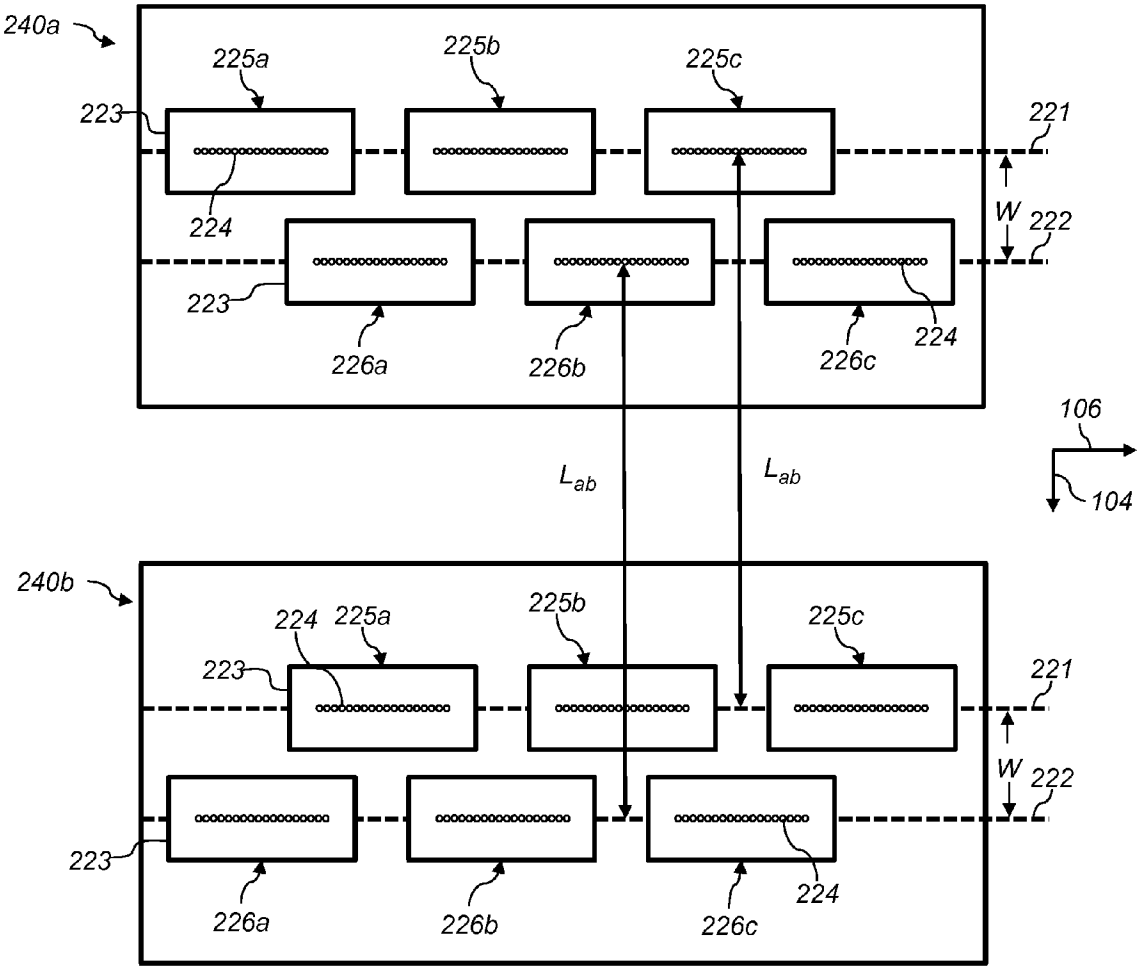
FIG. 6 is a view of a face of two digital printheads, each having two staggered print lines.

FIG. 6 illustrates an alternate configuration of printhead modules 223 within a pair of printheads 240*a* and 240*b* which can be used to satisfy the design criteria set forth in this disclosure, without the use of a span extension member. In this embodiment, the staggered printhead modules 223 in printhead 240*b* are arranged in a mirror image configuration relative to the printhead 240*a*. In this case, the printheads 240*a*, 240*b* are operated such that a first color is jetted using print line 221 of print 240*a*, and the same first color is jetted in using print line 221 of printhead 240*b*. Since the printhead modules 223 in these print lines are provided in a staggered arrangement, they will fully cover the entire media width. Similarly, a second color is jetted in using print line 222 in the print head 240*a* and the print line 222 in the print head 240*b*. According to this arrangement, the distance between the print locations used to print the first color will be $L_{ab}$ and the distance between the print locations used to print the second color will also be $L_{ab}$.

Figure 7:
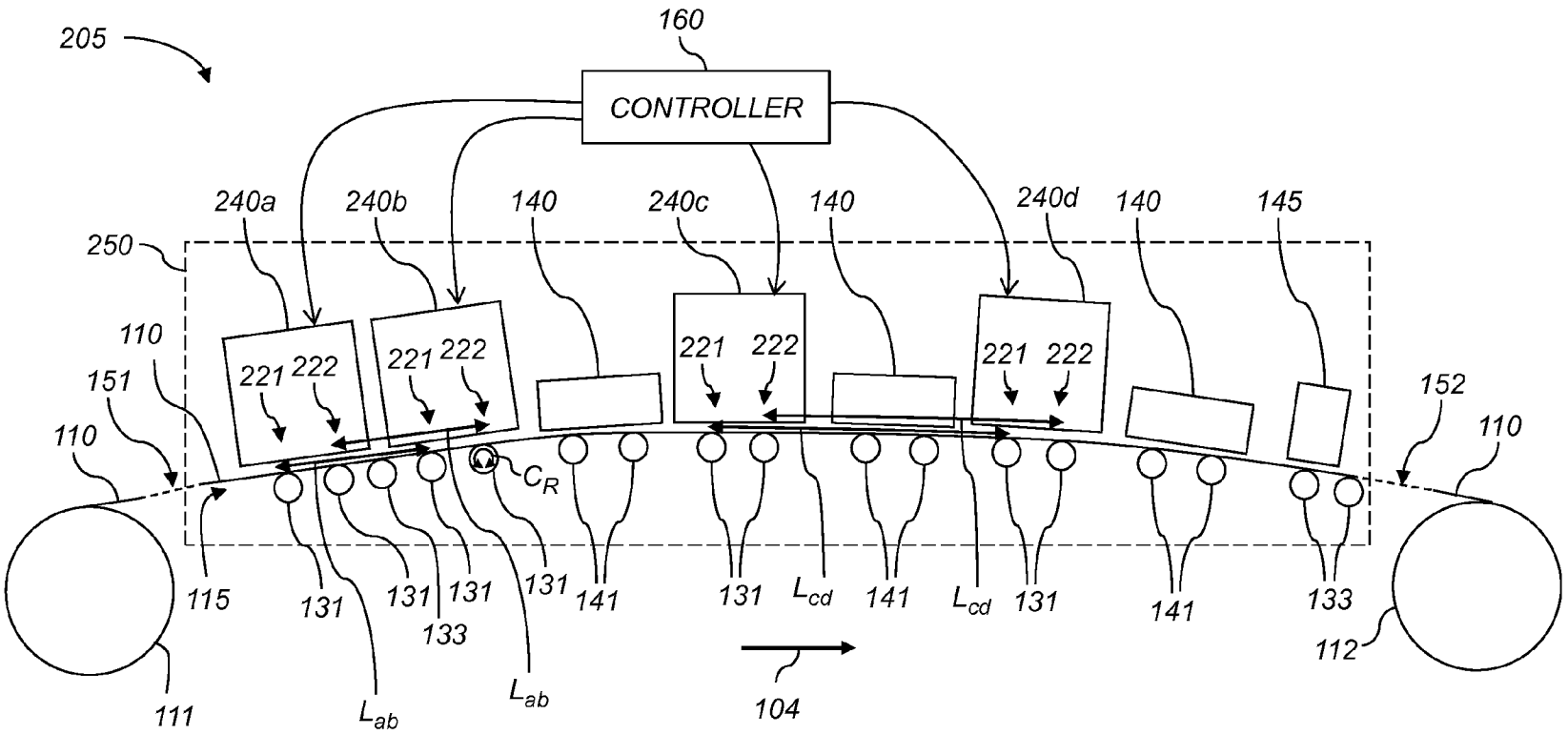
FIG. 7 is a simplified side view of a digital printing system for printing on a web of media using two-print-line printheads shown in FIG. 6.

FIG. 7 illustrates an inkjet printing system 205 using the printheads 240*a*, 240*b* of FIG. 6. The third and fourth printheads 240*c* and 240*d* used for printing third and fourth colors are also provided using an analogous arrangement. According to this configuration, if the web-transport rollers (e.g., print line rollers 121, support rollers 133 and dryer rollers 141) are selected to satisfy the design criterion that their circumferences $C_R$ be integer fractions of $L_{ab}$ and $L_{cd}$ (i.e., they satisfy the design criterion given in Eq. (2)), then this will provide a consistent phase relationship of the angular orientations within a particular color channel. As a result, any irregularities in the motion of the web of media 110 should be consistent between the locations that a given color is printed (e.g., between print line 221 of print 240*a* and print line 221 of printhead 240*b* and between print line 222 of print 240*a* and print line 222 of printhead 240*b*).

For the embodiment illustrated in FIG. 6-7, the design criterion given in Eq. (3) that the roller circumference be an integer fraction of the print line spacing distance W can optionally be relaxed. This enables the use of larger diameter rollers without using span extension rollers 135 (FIG. 5). For cases where Eq. (3) is not satisfied, the phase relationships of the angular orientations of the rollers will be different for the first and second colors. However, since the phase relationship will be consistent and predicable within a particular color, the resulting position errors can be characterized and corrected on a color-by-color basis to correct any color-to-color registration errors that might result.

Figure 8:
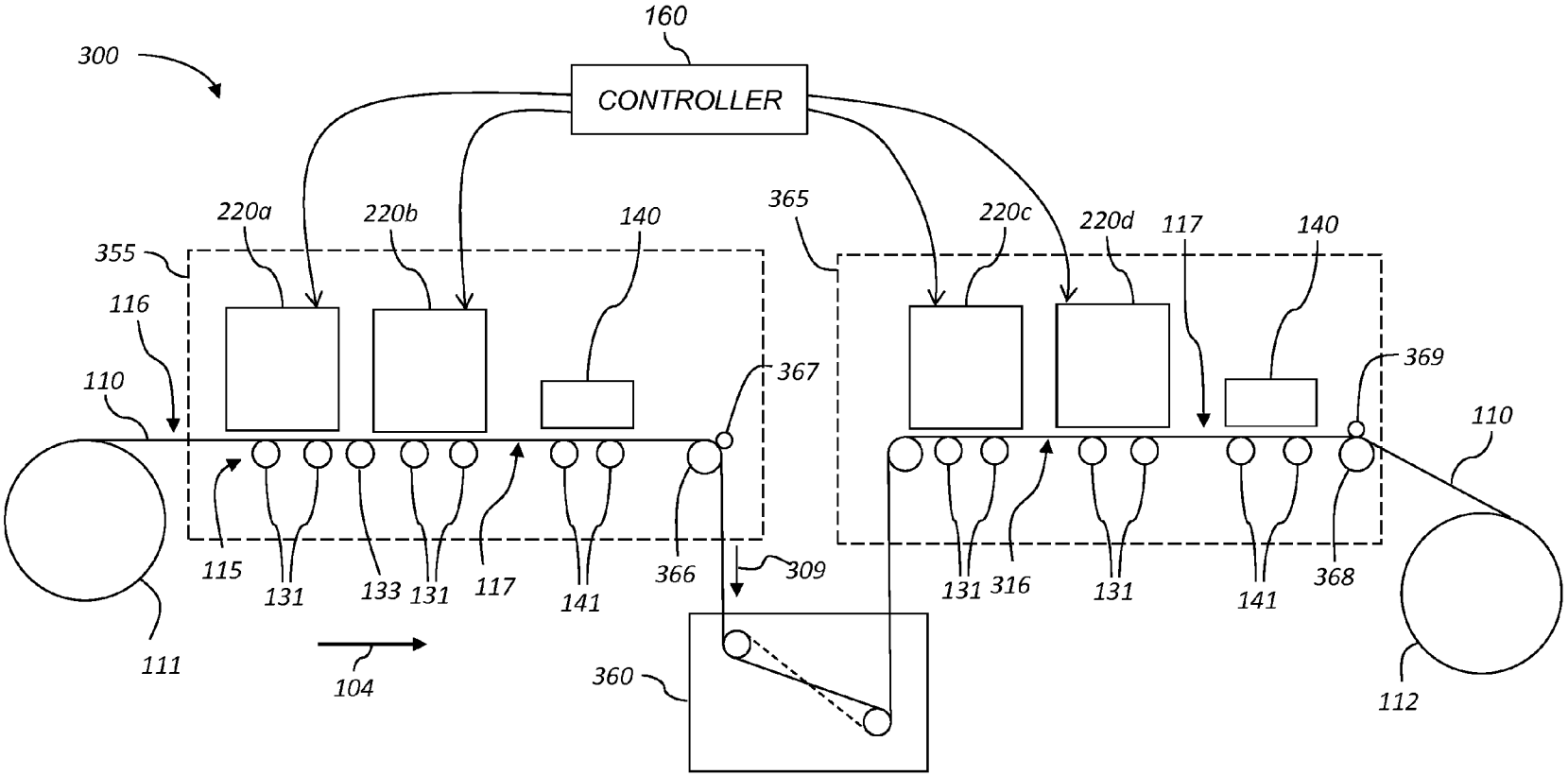
FIG. 8 is a simplified side view of a digital printing system for printing on both sides of a web of media.

Referring to FIG. 8, there is shown a simplified side view of a portion of an inkjet printing system 300 for printing on both a first side 116 and a second side 117 of a continuous web of media 110 that is advanced along media advance direction 104 from supply roll 111 to take-up roll 112. Inkjet printing system 300 includes a first printing module 355, for printing on a first side 116 of the web of media 110, having two printheads 220*a*, 220*b* and a dryer 140; a turnover mechanism 360; and a second printing module 365, for printing on the second side 117 of the web of media 110, having two printheads 220*c*, 220*d* and a dryer 140. Web transport rollers guide the web of media 110 from upstream to downstream along web transport path 115 through the first printing module 355 and the second printing module 365. The web transport rollers include print line rollers 131 aligned with the print lines (not shown in FIG. 8) of the printheads 220*a*, 220*b*, 220*c*, 220*d*. These print line rollers 131 maintain the web of media 110 at a fixed spacing from the printheads to ensure a consistent time of flight for the print drops emitted by the printheads 220*a*, 220*b*, 220*c*, 220*d*. The web transport rollers also include dryer rollers 141 and other support rollers 133. The web transport rollers also include a drive roller 366 which applies tension to the web of media 110 and directs it along exit direction 309 of first printing module 355 toward the turnover mechanism 360. A nip roller 367 holds the web of media 110 in contact with the drive roller 366. The web transport rollers also include a second drive roller 368 near the exit of second printing module 365 which applies tension to the web of media 110 and directs it toward take-up roll 112. A nip roller 369 holds the web of media 110 in contact with the drive roller 368. Motors (not shown in FIG. 8) rotate drive rollers 366, 368, thereby providing a force to move the web of media 110 along the web transport path 115. The other web transport rollers, including print line rollers 131, span extension rollers 135 (FIG. 5), dryer rollers 141, and other support rollers 133 can be freely rotating idler rollers. As in the previously discussed embodiments, each of the plurality of web transport rollers, including drive rollers 366, 368 as well as the idler rollers, preferably has a roller circumference $C_R$ that is substantially equal to an integer fraction of a span of web of media 110 between two successive print locations.

Transport roller size has previously been considered in different ways for web transport in a printing system. For example, Kodak's NexPress line of color electrophotographic printers has a seamed transport web for advancing cut sheets of paper past a series of electrophotographic print modules. All rollers used in this assembly, including the main drive roller, tension roller, steering roller, detack roller, touch down roller, guide rollers, and paper transfer rollers are designed in a way that their circumference matches an integer fraction of the print module-to-module spacing. So, for example, the main drive roller rotates exactly 3 times while the transport web moves from one print module to the next, while the receiver is firmly attached to the transport web. In consequence, all periodic variations due to roller run-out or unbalance that might cause an in-track timing problem stay in phase between the print modules and do not show up as a print registration problem. Line spacing might vary from the ideal pitch (e.g., 600 lines per inch), but registration is not affected because the variation occurs in the same way in all print modules. Although the motivation of precision registration is similar in the present invention, the design criterion is different for printing systems using a continuous web of media 110 rather than cut sheets as in the NexPress printers. Rather than the transfer rollers having a circumference that is equal to an integer fraction of the print module-to-module spacing as in the cut sheet system, the web transport rollers have a circumference that is equal to an integer fraction of a span of the web of media 110 between two successive print locations. The design criterion for web transport systems allows for web transport paths that are not straight lines between successive print locations.

Figure 9:
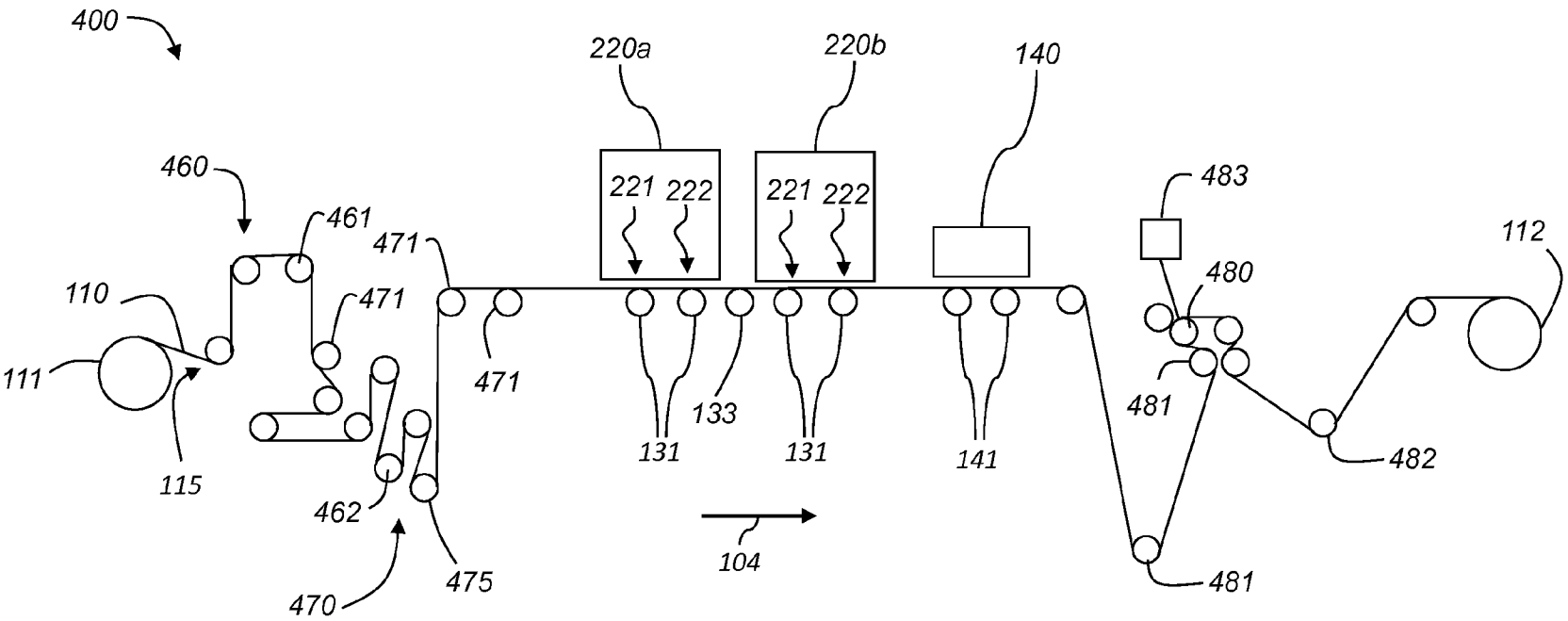
FIG. 9 shows a schematic view of a portion of a digital printing system including additional web transport rollers near the supply roller and the take-up roller.

Other differences in design criteria in embodiments of the invention result from a roll-to-roll printing system architecture. With reference to FIG. 2, the supply roll 111 continues to decrease in diameter, while the take-up roll 112 continues to increase in diameter as the web of media 110 is advanced through printing system 100. FIG. 9 shows a schematic side view of a portion of an inkjet printing system 400 where only two printheads 220*a*, 220*b* are visible, in order to illustrate additional rollers between supply roll 111 and the first print location (first print line 221 of first printhead 220*a*), as well as between the last print location (second print line 222 of second printhead 220*b*) and take-up roll 112.

Inkjet printing system 400 includes a media guiding subsystem 460 downstream of supply roll 111. The media guiding subsystem 460 can move side-to-side and helps to guide the web of media 110 to start down the web transport path 115 as it unwinds from supply roll 111, and generally includes one or more web-transport rollers 461 and other components such as edge guides and control systems. An out-of-round supply roll 111 will cause disturbances on the motion of the web of media 110 at increasing frequency as the web is unwound. A front-end motion isolation mechanism, such as an S-wrap tensioning subsystem 470 is commonly provided to buffer such disturbances and allow a steady motion of the continuous web of media 110 at controlled tension throughout the inkjet printing system 400. The S-wrap tensioning subsystem 470 generally includes two or more web-transport rollers 462 which define an S-shaped media path. In alternate embodiments, other types of motion isolation mechanism can be used such as slack loops or festoons. Additional web transport rollers 471 are located along the web transport path 115 between the supply roll 111 and the first print location associated with the first print line 221 of first printhead 220*a*.

On the output side of inkjet printing system 400, a main drive roller 480 driven by a motor 483 is used to pull the web of media 110 at a predetermined tension measured with a load cell roller 475. The main drive roller 480 also serves the function of a back-end motion isolation mechanism to isolates the printheads 220*a*, 220*b* from the take-up roll 112. In alternate embodiments, other types of motion isolation mechanism can be used such as slack loops or festoons. Additional web transport rollers 481 are also located along the web transport path 115 between the last print location (corresponding to the second print line 222 of the second printhead 220*b*) and the take-up roll 112.

The design criterion described above constraining the circumference of each of the web transport rollers, is preferably also applied to some or all of the web transport rollers 471, 481, 482, the load cell roller 475, the main drive roller 480, and any rollers associated with the media-guiding subsystem 460 and the S-wrap subsystem 470. In some embodiments one or more of the constrained web-transport rollers can include encoders or tachometers that are used to characterize web motion. There is particular benefit to constraining the web-transport rollers 471 between the S-wrap tensioning subsystem 470 and the first printhead 220*a*, as well as the web-transport rollers 462, 475 in the S-wrap tensioning subsystem 470, to be selected according to the aforementioned design criteria. Since the S-wrap tensioning subsystem 470 serves to effectively isolate the supply roll 111 and media guiding subsystem 460 from the printheads 220*a*, 220*b*, the benefit of constraining any web-transport rollers 461 upstream of the S-wrap tensioning subsystem 470 to conform to the design criteria is reduced. Likewise, it is preferable that the main drive roller 480, as well as any web-transport rollers 481 between the last printhead 220*b* and the main drive roller 480, be constrained to satisfy the aforementioned design criteria. Since the main drive roller 480 effectively isolates the printheads 220*a*, 220*b* from the take-up roll 112, the benefit of constraining the web-transport rollers 482 downstream of the main drive roller 480 to conform to the design rule is reduced.

Figure 10:
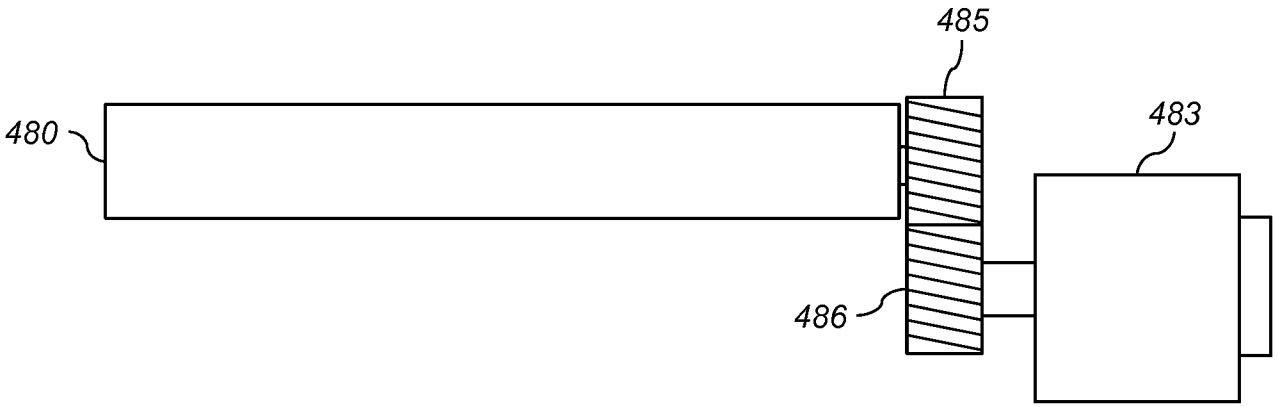
FIG. 10 shows components for driving the main drive roller of FIG. 9 according to an exemplary embodiment.

In some embodiments, the main drive roller 480 is driven by the motor 483 using a direct servo drive. In other embodiments, as illustrated in FIG. 10, a driven gear 485 can be affixed to one end of the main drive roller 480 and a gear train including one or more drive gears 486 is used to transfer torque from the motor 483 to the main drive roller 480. In this example, the gear train includes a single drive gear 486 which is affixed to a shaft of the motor 483. However, in other embodiments, more than one drive gear 486 can be included in the gear train between the motor 483 and the driven gear 485. For the same reasons that were discussed earlier with respect to the diameters of the web-transport rollers, it is desirable that each of the gears in these gear trains (e.g., driven gear 485 and drive gear 486) should rotate substantially an integer number of times as the web of media 110 is advanced by the distance between two successive print locations. This can be achieved by proper design of the gear ratio between the driven gear 485 on the main drive roller 480 and each of the drive gears 486. Assuming that the main drive roller 480 is designed to satisfy the aforementioned design criteria that its circumference be equal to an integer fraction of the span between two successive print locations, constraining the gear ratios of the gears such that they rotate an integer number of times for each rotation of the main drive roller 480 will provide the desired result. For example, if the main drive roller 480 has a circumference which is one third of span between two successive print locations, the main drive roller 480, and therefore the driven gear 485, will rotate 3× as the web of media 110 is advanced from one print location to the next. And if the driven gear 485 has the same number of teeth as the drive gear 486 (i.e., a 1:1 gear ratio), the drive gear 486 will rotate at the same rate as the driven gear 485, and will therefore also rotate 3× as the web of media 110 is advanced from one print location to the next. In some embodiments, there may be a plurality of driven rollers (e.g., drive rollers 366, 368 in FIG. 8). In such cases, this design criterion is preferably applied to all gears associated with all of the driven rollers. Preferably this design criterion is satisfied to within 1%, and more preferably is satisfied to within 0.1%.

The invention has been described in detail with particular reference to certain preferred embodiments thereof, but it will be understood that variations and modifications can be effected within the spirit and scope of the invention.

PARTS LIST

100 printing system
104 media advance direction
106 marking element array direction
110 web of media
111 supply roll
112 take-up roll
115 web transport path
116 first side
117 second side
120 printhead
120*a* printhead
120*b* printhead
120*c* printhead
120*d* printhead
121 print line
121*a* print line
121*b* print line
121*c* print line
121*d* print line
123 printhead module
124 marking element array
130 support structure
131 print line roller
133 support roller
135 span extension roller
139 surface
140 dryer
141 dryer roller
145 quality control sensor
150 printing module
151 first zone
152 second zone
160 controller
200 inkjet printing system
205 inkjet printing system
220 printhead
220*a* printhead
220*b* printhead
220*c* printhead
220*d* printhead
221 print line
222 print line
223 printhead module
224 nozzles
225*a* inkjet nozzle array
225*b* inkjet nozzle array
225*c* inkjet nozzle array
226*a* inkjet nozzle array
226*b* inkjet nozzle array
226*c* inkjet nozzle array
230 support structure
239 surface
240*a* printhead
240*b* printhead
240*c* printhead
240*d* printhead
250 printing module
300 inkjet printing system
309 exit direction
355 first printing module
360 turnover mechanism
365 second printing module
366 drive roller
367 nip roller
368 drive roller
369 nip roller
400 inkjet printing system
460 media-guiding subsystem
461 web transport roller
462 web transport roller
470 S-wrap tensioning subsystem
471 web transport roller
475 load cell roller
480 main drive roller
481 web transport roller
482 web transport roller
483 motor
485 driven gear
486 drive gear
$C_R$ roller circumference
L span
$L_{ab}$ span
$L_{bc}$ span
$L_{cd}$ span
M integer
N integer
$N_1$ integer
$N_2$ integer
$N_3$ integer
R non-printing region
S speed
V overlap region
W spacing distance
$W_e$ extended spacing distance
Δt timing delay

The invention claimed is:

1. A printing system for printing on a web of media traveling along a web transport path, comprising:

a plurality of printheads for printing on the web of media, each of the printheads being configured to print at one or more corresponding print locations along the web transport path, wherein at least one of the printheads includes:

a first group of marking elements arranged along a first print line; and a second group of marking elements arranged along a second print line, the second print line being spaced apart from the first print line along a media advance direction, such that the first print line and the second print line correspond to successive print locations;

a plurality of web transport rollers to guide the web of media along the web transport path, including:

a first print line roller aligned with the first print line;

a second print line roller aligned with the second print line; and a span extension roller disposed along the web transport path between the first print line roller and the second print line roller for increasing the span of the web of media along the web transport path between the first print line and the second print line;

wherein at least some of the web transport rollers are constrained web transport rollers that are constrained to have a roller circumference that is substantially equal to an integer fraction of a span of the web of media along the web transport path between two successive print locations, and the span extension roller being one of the constrained web transport rollers.

2. The printing system of claim 1, wherein all of the constrained web transport rollers have the same roller circumference.

3. The printing system of claim 1, wherein the constrained web transport rollers include one or more drive rollers.

4. The printing system of claim 1, wherein the constrained web transport rollers include one or more idler rollers.

5. The printing system of claim 1, wherein all of the web transport rollers located along the web transport path between successive print locations are constrained web transport rollers.

6. The printing system of claim 1, wherein the web of media travels along the web transport path from a supply roll to a take-up roll, and wherein at least one of the constrained web transport rollers is located along the web transport path between the supply roll and a first print location.

7. The printing system of claim 6, further including a front-end motion isolation mechanism located along the web transport path between the supply roller and the first print location, and wherein all of the web-transport rollers located along the web transport path between the front-end motion isolation mechanism and the first print location are constrained web-transport rollers.

8. The printing system of claim 1, wherein the web of media travels along the web transport path from a supply roll to a take-up roll, and wherein at least one of the constrained web transport rollers is located along the web transport path between a last print location and the take-up roll.

9. The printing system of claim 8, further including a back-end motion isolation mechanism located along the web transport path between the last print location and the take-up roller, and wherein all of the web-transport rollers located along the web transport path between the last print location and the back-end motion isolation mechanism are constrained web-transport rollers.

10. The printing system of claim 1, wherein the printing system has first, second and third print locations arranged successively along the web transport path, and wherein a first span of the web of media between the first and second print locations is different than a second span of the web of media between the second and third print locations.

11. The printing system of claim 10, wherein the roller circumference of the constrained web transport rollers is substantially equal to integer fractions of both the first span of the web of media and the second span of the web of media.

12. The printing system of claim 1, wherein the printing system is an inkjet printing system and the printheads are inkjet printheads.

13. The printing system of claim 1, wherein at least one of the printheads prints on a first side of the web of media, and at least one of the printheads prints on an opposing second side of the web of media.

14. The printing system of claim 1, wherein the roller circumference of the constrained web transport rollers is equal to an integer fraction of a span of the web of media along the web transport path between two successive print locations to within 1.0%.

15. The printing system of claim 1, wherein the roller circumference of the constrained web transport rollers is equal to an integer fraction of a span of the web of media along the web transport path between two successive print locations to within 0.1%.

16. The printing system of claim 1, further including a controller which adjusts a position that image data is printed by a particular printhead on a line-by-line basis according to a correction function, wherein the correction function is determined by characterizing registration errors as a function of position within an image frame.

* * * * *